US005602556A

United States Patent [19]

Bowers

[11] Patent Number: 5,602,556

[45] Date of Patent: Feb. 11, 1997

[54] TRANSMIT AND RECEIVE LOOP ANTENNA

[75] Inventor: John H. Bowers, Clarksburg, N.J.

[73] Assignee: Check Point Systems, Inc., Thorofare, N.J.

[21] Appl. No.: 482,680

[22] Filed: Jun. 7, 1995

[51] Int. Cl.[6] ..... H01Q 11/12

[52] U.S. Cl. ..... 343/742; 343/867; 340/572

[58] Field of Search ..... 343/742, 866, 343/867, 741; 342/27, 51; 340/572, 552; H01Q 11/12

[56] References Cited

U.S. PATENT DOCUMENTS

| | | | |
|---|---|---|---|
| 3,588,905 | 6/1971 | Dunlavy, Jr. | 343/867 |
| 3,696,379 | 10/1972 | Minary | 340/280 |
| 3,938,044 | 2/1976 | Lichtblau | 325/22 |
| 4,251,808 | 2/1981 | Lichtblau | 340/572 |
| 4,260,990 | 4/1981 | Lichtblau | 343/742 |
| 4,308,530 | 12/1981 | Kip et al. | 340/572 |
| 4,373,163 | 2/1983 | Vandebult | 343/842 |
| 4,509,039 | 4/1985 | Dowdle | 340/572 |
| 4,628,324 | 12/1986 | Gross et al. | 343/788 |
| 4,633,250 | 12/1986 | Anderson, III | 342/27 |
| 4,679,046 | 7/1987 | Curtis et al. | 342/51 |
| 4,751,516 | 6/1988 | Lichtblau | 343/742 |
| 4,769,631 | 9/1988 | Copeland | 340/551 |
| 4,799,045 | 1/1989 | Fearon et al. | 340/572 |
| 4,866,424 | 9/1989 | Parks | 340/551 |
| 4,872,018 | 10/1989 | Feltz et al. | 343/742 |
| 4,890,115 | 12/1989 | Hartings | 343/742 |
| 4,922,261 | 1/1990 | O'Farrell | 343/742 |
| 4,963,880 | 10/1990 | Torre et al. | 343/866 |
| 4,999,641 | 3/1991 | Cordery et al. | 343/742 |
| 5,061,941 | 10/1991 | Lizzi et al. | 343/742 |
| 5,103,234 | 4/1992 | Watkins et al. | 343/742 |
| 5,103,235 | 4/1992 | Clemens | 343/742 |
| 5,121,103 | 6/1992 | Minasy et al. | 340/551 |
| 5,121,105 | 6/1992 | Aittoniemi | 340/572 |
| 5,130,697 | 7/1992 | McGinn | 340/551 |
| 5,257,033 | 10/1993 | Roche | 343/742 |

FOREIGN PATENT DOCUMENTS

| | | | |
|---|---|---|---|
| 2506524 | 11/1982 | France | 343/742 |
| 0116304 | 9/1981 | Japan . | |
| PCT/NL91/00074 | 11/1991 | Netherlands . | |

*Primary Examiner*—Hoanganh T. Le

*Attorney, Agent, or Firm*—Panitch Schwarze Jacobs & Nadel, P.C.

[57] ABSTRACT

A transmit and receive loop antenna includes a first loop element coupled to an electrical circuit element for generating near fields and far fields and a shunt loop element surrounding the first loop element such that voltages are induced in the shunt loop element by the fields generated by the first loop element. The shunt loop element is constructed from a continuous loop of conductor to maximize current from the voltages induced in the shunt loop element. The current in the shunt loop element generates fields which largely cancel the fields generated by the first loop element in the far field. Thus, the first loop element and the shunt loop element establish a surveillance zone in an area proximate the loop elements. A second loop element, such as a figure-8 loop element may be placed proximate the first loop element and the shunt loop element for receiving electromagnetic energy radiated by a tag circuit which enters the surveillance zone. The tag circuit inside the surveillance zone may be powered by the emitted electromagnetic field of the first loop element and the shunt loop element.

19 Claims, 2 Drawing Sheets

TRANSMIT AND RECEIVE LOOP ANTENNA

FIELD OF THE INVENTION

The present invention generally relates to antennas and more particularly, to loop antennas which generate fields that are generally cancelling at distances of one wavelength or more from the antenna.

BACKGROUND OF THE INVENTION

In certain known types of electronic systems, particularly those designed for electronic article surveillance (EAS), it is known to provide a composite antenna comprising two or more antennas coupled to each other and to which signals from a transmitter are supplied in order to produce a surveillance zone comprising an induction field adjacent the composite antenna which is sufficiently strong to detect the presence near the antenna of predetermined types of objects. Generally, EAS systems include both a transmit antenna and a receive antenna which collectively establish a surveillance zone, and tags which are attached to articles being protected. The transmit antenna generates an electromagnetic field within a range of a first predetermined frequency. The tags each include a resonant circuit having a predetermined resonant frequency generally equal to the first frequency. When one of the tags is present in the surveillance zone, the field generated by the transmit antenna induces a voltage in the resonant circuit in the tag, which causes the resonant circuit to generate an electromagnetic field, causing a disturbance in the field within the surveillance zone. The receive antenna detects the electromagnetic field disturbance and generates a signal indicating the presence of the tag (and thus, the protected article attached to the tag) in the surveillance zone.

In order to avoid the production of relatively strong electromagnetic fields which might interfere with the operation of other electronic apparatus, it is desirable to design such EAS systems so that the net effect of the radiated fields at positions remote from the antennas (generally is thirty meters) substantially zero, or at least insufficient to cause any serious problem.

In order to provide the desired far field cancellation, it is known to construct the composite antenna of a plurality of loops, the planes of which are substantially parallel and adjacent but displaced from each other, and in which the transmitter current flow is adjusted in phase and amplitude in different loops, so that the fields produced by the loops essentially add up to zero. Using such a composite antenna, it has been found possible to provide canceling in the far field by suitable choice of the cross-sectional areas and numbers of turns in the several loop antennas.

Although such composite antennas provide far field cancellation, the orientation of the magnetic fields due to the respective loop antennas are essentially constant at any point in space proximate to the antennas. For example, in the case of two loops of equal area offset from each other in the plane of the loops such that a figure-8 current path is described (i.e. one loop having a clockwise current direction and the other having a counter-clockwise current direction) and wherein the number of ampere turns in the loops are equal, a zone will exist in a second plane perpendicular to the plane of the loops and passing through a mid-point between the two loops wherein the field orientation is perpendicular to the second plane. However, essentially no field will exist in any direction within the second plane. In an EAS system, this substantially reduces the coupling probabilities and substantially inhibits the coverage of the surveillance zone.

The present invention provides an antenna including at least one active loop for generating and responding to fields located proximate to, and preferably within a larger, passive loop, which substantially cancels the far fields generated by the active loop or those far fields to which the active loop is responsive. By providing a separate loop for reducing far field coupling, the active loop may be driven by a transmitting circuit with a relatively high current, while still meeting regulatory requirements for far field radiation. This allows for an antenna with relatively larger fields in more than one orientation within close proximity to the antenna. It also allows for a separate receive antenna which is highly sensitive to externally emitted signals to be placed proximate the active and passive loops.

An antenna of the present invention may be used to advantage in systems where simultaneous transmission and reception occurs, or where it is desired to phase different elements of the antenna in different phases and/or frequencies. Providing different phases allows the antenna to strongly couple in more than one direction at a point.

The antenna may be used in an EAS system and provides larger fields in as many orientations as possible within as close proximity of the antenna as possible, thereby causing a tag to respond, and simultaneously providing an antenna pick-up pattern which is also uniformly sensitive to emitted radio frequency (RF) signals such that the tag responses can be sensed.

SUMMARY OF THE INVENTION

Briefly stated, the present invention is for a far field cancelling antenna comprising an electrical circuit element and a first antenna structure. The first antenna structure comprises a first loop element electrically coupled to the circuit element which, when the circuit element is a transmitter, may be used for generating fields and a shunt loop element surrounding the first loop element such that voltages are induced in the shunt loop element from the fields generated by the first loop element. The shunt loop element comprises a continuous conductive loop to maximize currents from the voltages induced therein. The currents in the shunt loop element generate fields which largely cancel in the far field the fields generated by the first loop element.

The present invention also provides a far field cancelling antenna comprising an electrical circuit element, a first loop element electrically coupled to the circuit element, a shunt loop element surrounding the first loop element and a second loop element located proximate both the first loop element and the shunt loop element. The shunt loop element largely cancels the fields generated by the first loop element in the far field when the circuit element is a transmitter. The second loop element may be positioned such that coupling between the second loop element and both the first loop element and the shunt loop element is minimized. The shunt loop element comprises a continuous conductive loop to maximize currents from the voltages induced therein.

BRIEF DESCRIPTION OF THE DRAWINGS

The foregoing summary, as well as the following detailed description of preferred embodiments of the present invention, will be better understood when read in conjunction with the appended drawings. For the purpose of illustrating the present invention, there is shown in the drawings embodiments which are presently preferred. It should be understood, however, that the present invention is not limited to the particular arrangements and instrumentalities shown. In the drawings.

DETAILED DESCRIPTION OF THE INVENTION

Figure 1:
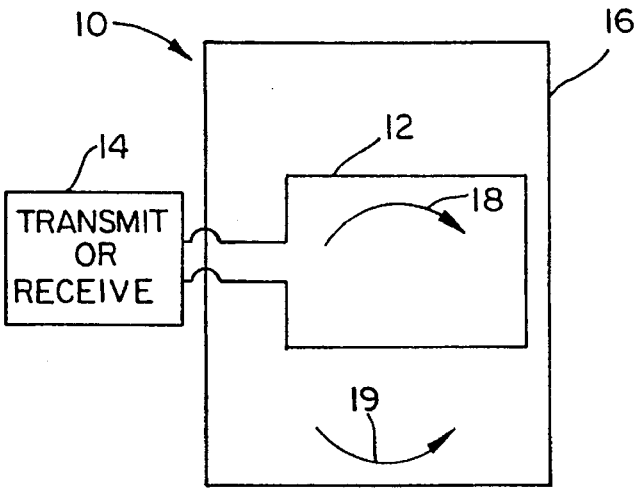
FIG. 1 is a schematic diagram of a far field cancelling antenna in accordance with a first embodiment of the present invention.

Certain terminology is used in the following description for convenience only and is not limiting. The words "top", "bottom", "lower" and "upper" designate directions in the drawings to which reference is made. The terminology includes the words above specifically mentioned, derivatives thereof and words of similar import.

The present invention is directed to an antenna which can simultaneously transmit and receive electromagnetic energy at one or more frequencies within a predetermined frequency range, wherein the size of the antenna may be less than the wavelength of the electromagnetic energy transmitted and received by the antenna. The antenna can also be used primarily as a transmit antenna or primarily as a receive antenna for creating a rotating field. The antenna of the present invention is well suited for use in systems where it is desirable to simultaneously transmit and/or receive electromagnetic fields within close proximity (i.e. less than one-half wavelength) of the antenna. An example of such a system is an electronic article surveillance (EAS) system where the antenna is used to establish a surveillance zone.

Referring now to the drawings in detail, wherein like numerals indicate like elements throughout, there is shown in FIG. 1 an electrical schematic diagram of a far field cancelling antenna 10 in accordance with a first preferred embodiment of the present invention for generating and/or coupling to electromagnetic fields. Preferably, the antenna system 10 is operative at radio frequencies, which preferably include frequencies above 1,000 Hz, and more preferably include frequencies above 5,000 Hz, and even more preferably include frequencies above 10,000 Hz. However, it should be understood that the antenna system 10 could be operated at lower frequencies without departing from the scope of the present invention.

The antenna 10 includes at least a first, active antenna loop element 12, an electrical circuit element 14 and a shunt loop element 16. The first antenna loop 12 comprises a generally rectangular-shaped loop which is electrically coupled to and driven by transmitter circuitry in the case of a transmitting antenna, and which is electrically coupled to and drives receiver circuitry in the case of a receiver antenna. For illustrative purposes, the first loop element 12 is shown as being generally rectangular in shape and with current flowing through the first loop element 12 in a clockwise direction as indicated by current flow arrow 18. Other loop sizes, shapes or configurations could be employed and the current could flow in the opposite direction if desired.

The first loop element 12 comprises a configuration of wire or conductors for carrying current and generating fields such that fields generated do not cancel in the far field. An antenna's far field is an area one or more wavelengths away from the antenna. For an antenna operating at 8.2 MHz, the Federal Communications Commission (FCC) defines the far field as an area thirty meters or slightly less than one wavelength from the antenna. In the present invention, the first loop element 12 generates electromagnetic fields in the far field. Although the first loop element 12 is shown as comprising a single turn loop, it will be apparent to those of ordinary skill in the art that the first loop element 12 could comprise a multi-loop element, such as a non-far field cancelling configuration of a three loop figure-8 (not shown) which is the functional equivalent of a single turn loop which generates far fields.

A current flowing through the first loop element 12 establishes a magnetic field having magnetic flux extending concentrically from at least a portion of the first loop element 12 and generally perpendicular to the current flow direction 18 as is well known in the art. In the presently preferred embodiment, the dimensions of the first loop element 12 are generally smaller than the wavelength of the electromagnetic field generated by the current flowing through the first loop element 12 divided by 27, such that the electric fields generated are largely independent of the magnetic fields generated.

The electrical circuit element 14 may comprise a current source electrically coupled to the first loop element 12 for supplying current to the first loop element 12 and which is capable of supplying sufficient current to the first loop element 12 for developing the aforementioned fields of electromagnetic energy. The electrical circuit element 14 could be a conventional transmitter comprising a signal oscillator (not shown) and a suitable amplifier/filter network (not shown) of a type capable of driving the load impedance presented by the first loop element 12. As will be appreciated, the frequency at which the first loop element 12 radiates electromagnetic fields substantially depends on the oscillation rate of the transmitter. Thus, the frequency may be set and adjusted by appropriately adjusting the transmitter in a well-known manner. Alternatively, the circuit element 14 may comprise receiver circuitry electrically coupled to the first loop element 12 for receiving electromagnetic energy from a transmitting antenna and/or the resonant circuit of a tag (not shown) for generating a signal indicative of whether a tag is present in the vicinity of the first loop element 12.

Electrical circuit elements of the type used in the present invention for transmitting and/or receiving are generally known. Such circuit elements are described, for instance, in U.S. Pat. No. 5,373,301, assigned to Checkpoint Systems, Inc., of Thorofare, N.J., the disclosure of which is incorporated herein by reference. A more detailed description of the electrical circuit element 14 is not required to understand the present invention.

The shunt loop element 16 comprises a continuous, generally rectangular shaped loop. The shunt loop element 16, although shown as being generally rectangular in shape, could comprise other shapes and sizes, such as circular. The shunt loop element 16 is not electrically connected to either a transmitter circuit or a receiver circuit. Rather, the shunt loop element 16 is a "passive" loop. The first loop element 12 and the shunt loop element 16, in the present embodiment, are generally coplanar, with the first loop element 12 preferably being located within or surrounded by the shunt loop element 16. The first loop element 12 interacts with the shunt loop element 16 primarily through mutual magnetic coupling between the elements 12, 16. The current flowing through the first loop element 12 in the direction indicated by the arrow 18 induces a current flow in the shunt loop element 16 in a direction opposite to the direction of the current flow in the first loop element 12, as indicated by the current flow arrow 19. As will be appreciated, the magnitude of the magnetic flux radiated by an antenna loop corresponds to the current flowing through the antenna loop multiplied by the area of the antenna loop. The shunt loop element 16 is a continuous conductive loop (i.e. a short circuit) so as to maximize the opposite phase current induced in the shunt loop element 16 from the first loop element 12. Thus, as will be understood by those of ordinary skill in the art, the size (area) of the shunt loop element 16 is determined based upon the required magnitude of the current induced in the shunt loop element 16 such that the electromagnetic fields generated by the shunt loop element 16 substantially cancel the electromagnetic fields generated by the first loop element 12 in the far field. Note that providing the shunt loop element 12 wherein an area of the shunt loop element 16 is larger than an area of the first loop element 12, provides for good far field cancellation.

Together, the first loop element 12 and the shunt loop element 16 comprise a first antenna structure wherein currents in the shunt loop element 16 generate fields which largely cancel the fields generated by the first loop element 12 in the far field. It has been found that such a structure, i.e. the first loop element 12 essentially located inside of the larger, passive loop or shunt loop element 16 comprises a far field cancelling antenna. It has further been found that other far field cancelling antennas, such as a figure-8 antenna, can be incorporated within this structure such that mutual coupling between the structure and the figure-8 antenna is minimized or essentially zero.

The first loop element 12 and the shunt loop element 16 each preferably comprise a conductor or wire of any suitable type. However, it will be appreciated that other conducting elements, such as a multiconductor wire, may be used, if desired, without departing from the scope of the present invention. For example, it may be desirable to use mechanically functional structural elements to make up the first loop element 12 and the shunt loop element 16. Alternatively, electrically conductive decorative elements may be used.

Figure 2A:
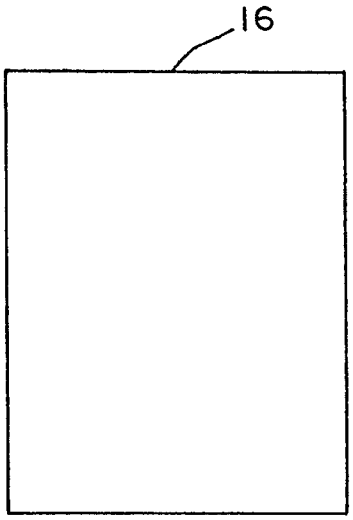
FIG. 2A is a schematic diagram of a shunt loop element in accordance with the present invention.
Figure 2B:
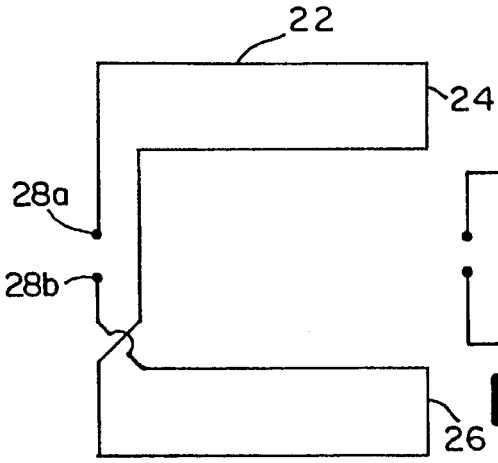
FIG. 2B is a schematic diagram of a figure-8 loop element in accordance with a second embodiment of the present invention.
Figure 2C:
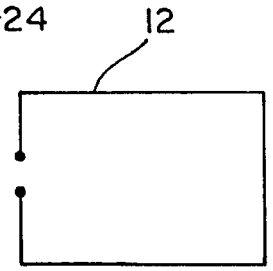
FIG. 2C is a schematic diagram of a figure-0 loop element in accordance with the present invention.

Referring now to FIGS. 2A through 2D a second embodiment of a far field cancelling antenna 20 is shown (FIG. 2D) along with the component parts of the antenna 20 (FIGS. 2A–2C). FIG. 2A is a schematic diagram of a shunt loop element 16 for use in the antenna 20. FIG. 2C is a schematic diagram of a first, active loop element 12 for use in the antenna 20 and FIG. 2B is a schematic diagram of a second loop element 22 for use in the antenna 20. Together, the first loop element 12 and the shunt loop element 16 comprise a first antenna structure, as shown in FIG. 1, where fields generated by voltages induced in the shunt loop element 16 cancel the fields generated by the first loop element 12 in the far field. Again, although the first loop element 12 is shown as a single turn or loop of conductor, it will be understood by hose of ordinary skill in the art that the first loop element 12 could have more than one turn.

Referring now to FIG. 2B, the second loop element 22 is essentially a figure-8 loop having an upper loop 24 and a lower loop 26. The second loop element 22, by itself, comprises a far field cancelling antenna, such as described in the aforementioned U.S. Pat. No. 5,373,301. As shown, the shape of the second loop element 22 has been modified such that the area of the upper loop 24 and the area of the lower loop 26 are smaller than they would normally be for a conventional figure-8 loop and the loops 24, 26 are spaced apart or are displaced from each other. This configuration is for convenience only, as it will be understood that the second loop element 22 may also comprise a conventional figure-8 loop or a differently modified figure-8 loop. For instance, the second loop element 22 could have more than two turns or loops 24, 26 and the second loop element 22 may be either symmetrical or asymmetrical. That is, the upper and lower loops 24, 26 need not necessarily be of equal area, nor must the upper and lower loops 24, 26 be connected in series. Alternatively, the upper and lower loops 24, 26 could be connected in parallel, or through an electrical network to introduce phase shifts between the two loops 24, 26. However, an important aspect of the second loop element 22 is, in general, to minimize the fields generated in the far field when configured as a transmitter.

The second loop element 22 also includes connection points **28*a*, 28*b* for connecting the second loop element 22 to an electrical circuit element (not shown). For instance, the second loop element 22 could be connected to a transmitter circuit and/or a receiver circuit. The connection points 28*a*, 28*b* are shown as being made proximate the geometric center of the second loop element 22, as this location is, in general, optimum. However, it will be understood that connections could be made at other points along the second loop element 22**.

Figure 2D:
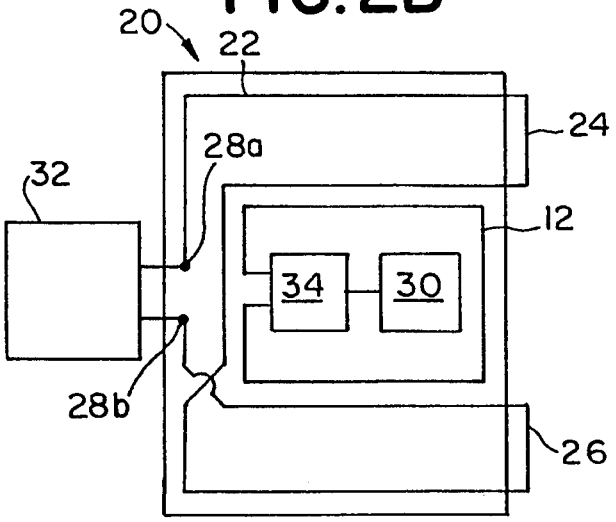
FIG. 2D is a schematic diagram of a far field cancelling antenna in accordance with the second embodiment of the present invention.

Referring now to FIG. 2D, a schematic diagram of the far field cancelling antenna 20 in accordance with a second embodiment of the present invention is shown, including each of the component parts shown in FIGS. 2A–2C. The first loop element 12 is shown connected to a transmitter 30 for generating a current to flow through the first loop element 12. The first loop element 12 is located within the shunt loop element 16 and the first loop element 12 and the shunt loop element 16 are sized and positioned so that coupling between the first loop element 12 and the shunt loop element 16 is adequate to obtain the aforedescribed far field cancelling effect. The second loop element 22 is positioned with respect to the first loop element 12 and the shunt loop element 16 such that magnetic coupling between second loop element 22 and the loop elements 12, 16 is minimized. In effect, the first loop element 12 generates fields which couple to the shunt loop element 16, but operates independently of the second loop element 22.

In the presently preferred embodiment, the first loop element 12 is located proximate the center of the shunt loop element 16 and is generally coplanar with the shunt loop element 16, and the second loop element 22 is located proximate to and parallel to the plane of the first loop element 12 and the shunt loop element 16, but is spaced from these elements such that none of the loop elements 12, 16, 22 is in direct electrical contact.

Also, the first loop element 12 and the shunt loop element 16 are substantially magnetically decoupled from the second loop element 22. The specific spatial relationship is one in which the loop elements partially overlap or overlie each other to the extent that the net flux generated from the coil of one of the loops is substantially zero within the area of the coil of the other loop and vice versa. Decoupling occurs when the second loop element 22 overlies the first loop element 12 and is spaced from the shunt loop element 16. By overlie, it is not meant that the loops are in contact or touching each other, but only that the loops are in a particular spatial relation to each other. That is, the loops are in parallel planes and have a common area such that a plane perpendicular to the loops at the common area will intersect each of the loops which are in "overlying" relation. As will be appreciated by those skilled in the art, a coupling coefficient exists between the first loop element 12 and the second loop element 22. In the presently preferred embodiment, the coupling coefficient is less than 0.5 and more preferably, the coupling coefficient is less than 0.1.

It has been found to be very advantageous to allow the first loop element 12 and the second loop element 16 to operate essentially independently of the second loop element 22. For example, the first loop element 12 may be driven by a transmitting circuit 30 with a relatively high current, as compared to an isolated figure-8 loop, while meeting the FCC or other regulatory agency requirements for far field radiation. At the same time, the second loop element 22 may be connected to a receiver circuit 32 at connection points 28*a*, 28*b*. This allows the antenna 20 to provide for simultaneous transmission and reception in a single housing or structure.

Alternatively, the first loop element 12 could be connected to an electrical network 34 for introducing phase shifts between the current in the first loop element 12 and the second loop element 22. Preferably, the currents are driven 90° out of phase from each other. By introducing phase shifts between the current driven through the first and second loop elements 12, 22, a rotating field is generated proximate the antenna 20. A single turn loop, such as first loop element 12 generates a perpendicular field and a figure-8 loop, such as the second loop element 22 generates a field parallel to the antenna 20 at a point away from the antenna 20. If the phase shift between the current driven in the first loop element 12 and the second loop element 22 is 90° apart, the orientation of fields generated by the loops 12, 22 is horizontal to vertical, and thus, a rotating field in regions proximate a center of the antenna 20, approximately in a plane perpendicular to the place of the antenna 20. The creation of a rotating field increases the detection in a surveillance system that incorporates the antenna 20 (i.e., increasing the number of orientations where good coupling can be achieved). Thus, the antenna 20 of FIG. 2D is desirable for use in an EAS system because the antenna 20 sensitivity provides improved tag detection.

In an EAS system, the first loop element 12 may be electrically coupled to the transmitting circuit 30 and the electrical network 34 for generating fields creating a surveillance zone. At the same time, the shunt loop element 16 generates fields which cancel the fields generated by the first loop element 12 in the far field. The second loop element 22 may be electrically coupled to the receiver circuit 32. When a tag (not shown) or article attached to the tag enters the surveillance zone, the tag is irradiated by the fields generated by the first loop element 12. The tag, in turn, resonates at a predetermined frequency, which is detected by the second loop element 22. The receiver circuit 32 then generates a signal indicating the presence of the tag in the surveillance zone.

Typically, the spacing in an EAS system between the transmit antenna and receive antenna is in the range of from two to six feet depending upon the particular EAS system and the particular application in which the system is being employed. In the present invention, the first antenna structure (i.e. the first loop element 12 and the shunt loop element 16) and the second loop element 22 are generally co-located, or located within a single structure, and establish a surveilled area or surveillance zone proximate thereto. In general, the surveillance zone is located at or near an exit or entrance to a facility (not shown) but it could be at any other location such as on either side or within a check out aisle. It will be appreciated by those skilled in the art that while, in the illustrated embodiment, the antenna 20 includes a transmitter circuit 30 connected to the first loop element 12 and a receiver circuit 32 connected to the second loop element 22, which are generally co-located, i.e., on the same side of the surveillance zone, there are other EAS systems well known to those skilled in the art in which the transmitter and receiver are separated by a predetermined distance to establish the surveillance zone. Accordingly, the particular antenna 20 and/or configuration described in FIG. 2D could be modified accordingly. For example, a first receive antenna (comprising the first loop element 12, the shunt loop element 16 and the second loop element 22) and a second, transmit antenna, generally identical to the receive antenna, but spaced therefrom, could be used in an EAS system to establish a surveillance zone.

Figure 3:
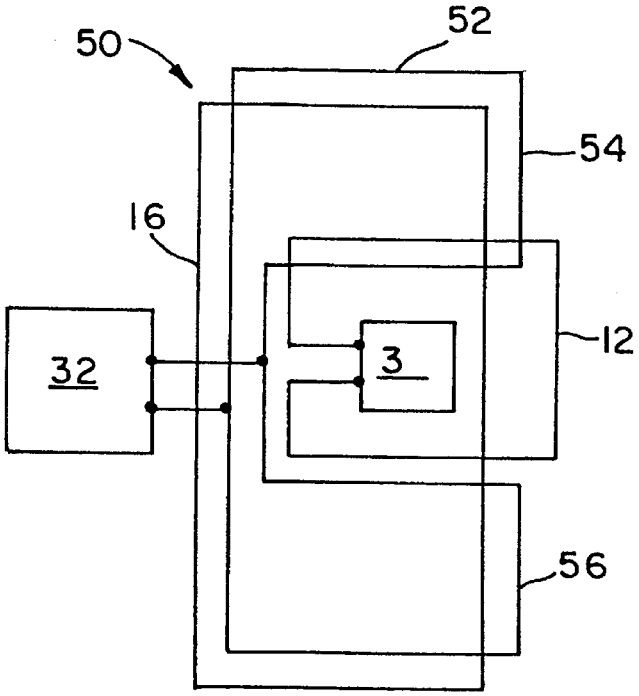
FIG. 3 is a schematic diagram of a far field cancelling antenna in accordance with a third embodiment of the present invention.

FIG. 3 is a schematic diagram of a third embodiment of a far field cancelling antenna system 50. The antenna 50 includes an active, first loop element 12 electrically connected to a transmitter circuit 30. The transmitter circuit 30 generates current which flows through the first loop element 12 for generating electromagnetic fields. A shunt loop element 16, which is larger in area than the first loop element 12, is positioned proximate to, and preferably surrounding the first loop element 12 for cancelling the fields generated by the first loop element 12 at a distance far from the first loop element 12 (i.e. far fields). As previously discussed, current which flows in a direction opposite to the flow of the current in the first loop element 12 is induced in the shunt loop element 16. The shunt loop element 16 is sized and positioned such that the induced current in the shunt loop element 16 generates fields which substantially cancel the fields generated by the first loop element 12 in the far field. A surveillance zone is created by the first loop element 12 and the shunt loop element 16 which is proximate to the first loop element 12 and the shunt loop element 16.

The antenna system 50 further includes a figure-8 loop element 52 electrically coupled to a receiver circuit 32. The figure-8 loop element 52 includes a top loop 54 connected to a bottom loop element 56. In the presently preferred embodiment, the top loop element 54 and the bottom loop element 56 are of generally equal area and are spaced or displaced from each other. The figure-8 loop element 52 detects the presence of a tag (not shown), as discussed in relation to FIG. 2D, which enters the surveillance zone. The tag responds to the magnetic near fields generated by the first loop element 12. The figure-8 loop element 52 receives the tag response from which an alarm signal may be generated indicating the presence of a tag in the surveillance zone. The figure-8 loop element 52, by itself, is a far field cancelling antenna, as a current flowing in the top loop 54 is equal in magnitude to the current flowing in the bottom loop 56, but flowing in an opposite direction.

Figure 4:
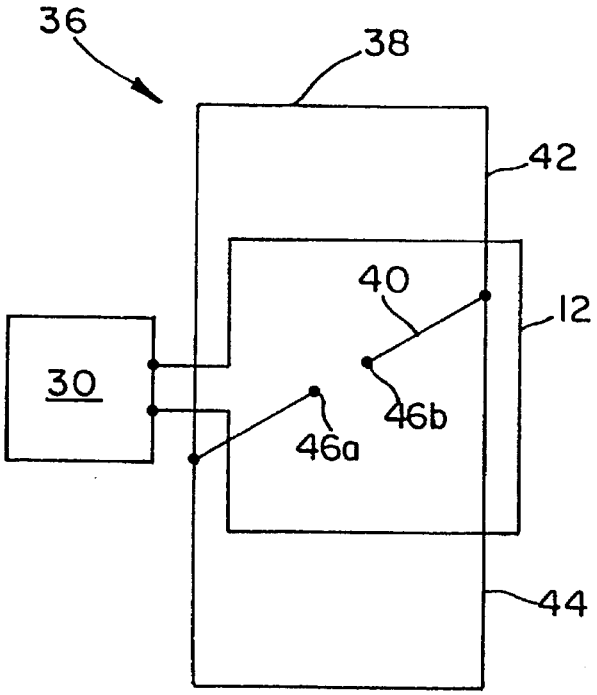
FIG. 4 is a schematic diagram of a far field cancelling antenna in accordance with a fourth embodiment of the present invention.

Referring now to FIG. 4, a schematic diagram of a fourth embodiment of a far field cancelling antenna 36 in accordance with the present invention is shown. In the fourth embodiment, a conventional figure-8 antenna loop element 38 having a crossbar 40 which divides the loop element 38 into two loops, a single turn top loop 42 and a single turn bottom loop 44. The crossbar 40 includes connection points 46*a*, 46*b* for connecting an electrical circuit element thereto. Either a transmitter circuit or a receiver circuit, as previously described, may be connected between the connection points 46*a*, 46*b*. In the presently preferred embodiment, the crossbar 40 is at an angle relative to the sides of the loop element 38. Orienting the crossbar 40 at an angle relative the sides of the loop element 38 helps in creating coupling at vertical angles. It will be understood by those of ordinary skill in the art that the actual angle of the crossbar 40 can be adjusted by various degrees depending upon desired performance requirements for the application of the antenna 36.

The top and bottom loops 42, 44 of the figure-8 loop element 38 are shown as being generally equal in area. As is well known, providing loops of equal areas aids in cancelling far field coupling. However, the top and bottom loops 42, 44 need not be of equal area, as other geometries which provide the desired cancelling properties in the far field may be used. The perimeter of the loop element 38 comprises a rectangular loop which may be used as a shunt loop, for being inductively coupled to an active loop, such as the first loop element 12.

The first loop element 12 is connected to an electrical circuit element, such as the transmitter circuit 30 previously described for developing a current in the first loop element 12. In the presently preferred embodiment, the first loop element 12 is overlaid on, but not in electrical or physical contact with, the figure-8 loop element 38. That is, the first loop element 12 is sized and placed such that when driven by a voltage or current source, the current flowing through the first loop element 12 induces a voltage in the perimeter of the figure-8 loop 38, and thereby a corresponding current flow in the perimeter of the figure-8 loop 38, with the objective being that a sum of the fields generated by the first loop element 12 and the perimeter of the figure-8 loop 38 are in opposite directions or phases and largely cancel each other in the far field. As will be appreciated, greater or lesser cancellation may be provided depending upon the relative size and positioning of the first loop element 12 with respect to the figure-8 loop 38.

Although particular embodiments of the present invention have been described, it will be apparent that the present invention may be altered or modified, yet still provide the desired far field cancellation. For instance, although the first loop element 12 has been described as a single loop, the first loop element 12 could comprise a three loop configuration having poor far field cancelling properties due to reasons of asymmetry or phasing of the currents. However, when located proximate to or within the shunt loop element 16, so as to have good coupling between the near field components of the active loop 12 and the shunt loop 16, substantial far field cancellation occurs.

Although the antenna of the present invention is described herein with reference to EAS systems, it will be appreciated that such reference to EAS systems is provided for illustrative purposes only and is not limiting. The antenna of the present invention is well suited for use in many other types of applications, and more particularly, has application in any area in which the electromagnetic energy radiated by the antenna is used to perform a communication or identification function. For example, the antenna of the present invention can be used in conjunction with a sensor (which is powered, by the electromagnetic energy transmitted by the antenna) in an environment where it is difficult to power or otherwise communicate with the sensor via wires connected to the sensor. In this environment, the antenna could be used to remotely power and receive information from the sensor. For example, the antenna of the present invention could be used in conjunction with a sensor which measures a patient's blood sugar level, wherein the blood sugar level sensor is subcutaneously implanted into a patient's tissue. As will be appreciated, it is highly desirable that the patient's skin not be punctured with wires to connect to the sensor. It is also highly desirable to eliminate batteries from the sensor. With the present invention, it is possible to use the electromagnetic energy generated by the antenna to power the sensor located beneath the patient's skin and to simultaneously use the antenna to receive the electromagnetic energy transmitted by the sensor, where the electromagnetic energy transmitted by the sensor relates to the patient's blood sugar level. Another application is related to communicating with a passive transponder that identifies its owner for access control. Other useful applications of the present invention will also be apparent to those skilled in the art.

Accordingly, it will be appreciated that changes and modifications may be made to the above described embodiments without departing from the inventive concept thereof. Therefore, it is understood that the present invention is not limited to the particular embodiments disclosed, but is intended to include all modifications and changes which are within the scope and spirit of the invention as defined by the appended claims.

I claim:

1. A far field cancelling antenna comprising:

an electrical circuit element; and a first antenna structure, the first antenna structure comprising:

a first loop element electrically coupled to the circuit element for generating fields; and a shunt loop element surrounding and generally coplanar with the first loop element such that voltages are induced in the shunt loop element from the fields generated by the first loop element, the shunt loop element comprising a continuous, conductive loop to maximize current from the voltages induced therein, wherein the current in the shunt loop element generates fields which largely cancel in the far field the fields generated by the first loop element.

2. The antenna of claim 1 wherein the size of a antenna is substantially less than a wavelength of operation of the antenna such that the antenna primarily generates magnetic fields.

3. The antenna of claim 1 wherein the shunt loop element and the first loop element are partially magnetically coupled to each other.

4. The antenna of claim 1 wherein the circuit element comprises a transmitter.

5. The antenna of claim 1 wherein the circuit element comprises a receiver.

6. The antenna of claim 1 further comprising a second loop element located proximate the shunt loop element such that coupling between the second loop element and the first antenna structure is minimized.

7. The antenna of claim 6 wherein the second loop element comprises a generally planar figure-8 antenna loop, the figure-8 antenna loop having an upper loop and a lower loop.

8. The antenna of claim 7 wherein the upper loop and the lower loop are connected in series.

9. The antenna of claim 7 wherein the upper loop and the lower loop are connected in parallel.

10. The antenna of claim 6 further comprising an electrical network, wherein the first loop element and the second loop element are connected through the electrical network, the electrical network introducing phase shifts between the first loop element and the second loop element, thereby causing a rotating field to exist proximate to the antenna.

11. The antenna of claim 7 wherein the second loop element is electrically connected to a receiver circuit and the electrical circuit connected to the first loop element comprises a transmitter circuit, such that the antenna provides for simultaneous transmission and reception.

12. The antenna of claim 7 wherein the upper loop and the lower loop are displaced from each other.

13. The antenna of claim 7 wherein the upper loop and the lower loop are of equal area.

14. The antenna of claim 7 wherein the upper loop and the lower loop are symmetrical.

15. The antenna of claim 1 wherein the shunt loop element includes a crossbar, the cross bar dividing the shunt loop element into two loops, the two loops being connected at the crossbar.

16. The antenna of claim 15 wherein the first loop element is centered within the shunt loop element.

17. A far field cancelling antenna comprising:

an electrical circuit element;

a first loop element electrically coupled to the circuit element for generating fields;

a shunt loop element surrounding and generally coplanar with the first loop element such that voltages are induced in the shunt loop element from the fields generated by the first loop element, the shunt loop element comprising a continuous, conductive loop to maximize current from the voltages induced therein, wherein the current in the shunt loop element generates fields which largely cancel in the far field the fields generated by the first loop element; and a second loop element generally coplanar with and located proximate the shunt loop element such that coupling between the second loop element and the first loop element and the shunt loop element is minimized.

18. The antenna of claim 17 wherein the electrical circuit connected to the first loop element comprises a transmitter circuit and the second loop element comprises a generally planar figure-8 antenna loop, the figure-8 antenna loop having an upper loop and a lower loop, and wherein the second loop element is electrically connected to a receiver circuit, such that the antenna provides for simultaneous transmission and reception.

19. In an electronic article surveillance system, a far field cancelling antenna, the antenna comprising:

a first loop element;

a transmitter circuit electrically coupled to the first loop element for generating an electrical current to flow through the first loop element in a first direction, the current generating electromagnetic fields;

a shunt loop element positioned proximate to the first loop element such that an electrical current is induced in the shunt loop element from the fields generated by the first loop element, the electrical current in the shunt loop element flowing in a second direction opposite to the first direction, wherein the current in the shunt loop element generates fields which largely cancel in the far field the fields generated by the first loop element such that a surveillance zone is created in a near field; and a generally planar figure-8 loop element located proximate the shunt loop element such that coupling between the figure-8 loop element and the first loop element and the shunt loop element is minimized; and a receiver circuit electrically coupled to the figure-8 loop element for detecting magnetic resonance in the surveillance zone at a predetermined frequency and generating an alarm signal therefrom indicative of the presence of a protected article in the surveillance zone.

* * * * *